US009121137B2

(12) United States Patent
Viazmensky et al.

(10) Patent No.: US 9,121,137 B2
(45) Date of Patent: Sep. 1, 2015

(54) DISPERSIBLE ARTICLES AND METHODS OF MAKING THE SAME

(71) Applicants: Sellars Absorbent Materials, Inc., Milwaukee, WI (US); Solenis Technologies, L.P., Schaffhausen (CH)

(72) Inventors: Helen Viazmensky, Avon, CT (US); Martyn Reginald Searle Davis, East Granby, CT (US); Richard J. Riehle, Wilmington, DE (US); Marc Christopher Putnam, Newark, DE (US); Joel E. Goldstein, Universiy Heights, OH (US); Jerry Ballas, Rose Valley, PA (US); Doeung David Choi, Hockessin, DE (US)

(73) Assignees: SELLARS ABSORBENT MATERIALS, INC., Milwaukee, WI (US); SOLENIS TECHNOLOGIES, L.P., Schaffhausen (CH)

( * ) Notice: Subject to any disclaimer, the term of this patent is extended or adjusted under 35 U.S.C. 154(b) by 0 days.

(21) Appl. No.: 14/255,369

(22) Filed: Apr. 17, 2014

(65) Prior Publication Data

US 2014/0311696 A1 Oct. 23, 2014

Related U.S. Application Data

(60) Provisional application No. 61/813,092, filed on Apr. 17, 2013.

(51) Int. Cl.

| | |
|---|---|
| ***D21H 17/36*** | (2006.01) |
| ***D21H 17/06*** | (2006.01) |
| ***D21H 17/37*** | (2006.01) |
| ***D21H 17/34*** | (2006.01) |
| ***D21H 17/35*** | (2006.01) |
| ***D21H 17/00*** | (2006.01) |

(52) U.S. Cl.

CPC ..... *D21H 17/06* (2013.01); *D21H 17/34* (2013.01); *D21H 17/35* (2013.01); *D21H 17/36* (2013.01); *D21H 17/37* (2013.01); *D21H 17/375* (2013.01); *D21H 17/72* (2013.01)

(58) Field of Classification Search

USPC ..... 162/146, 131, 123, 135, 149; 428/172, 428/195.1; 442/59, 97, 149

See application file for complete search history.

(56) References Cited

U.S. PATENT DOCUMENTS

| | | | | |
|---|---|---|---|---|
| 3,658,745 | A | 4/1972 | Merrill et al. | |
| 3,879,257 | A | 4/1975 | Gentile et al. | |
| 4,279,959 | A | 7/1981 | Falgiatore et al. | |
| 5,252,332 | A | 10/1993 | Goldstein | |
| 5,312,883 | A | 5/1994 | Komatsu et al. | |
| 5,317,063 | A | 5/1994 | Komatsu et al. | |
| 5,384,189 | A | 1/1995 | Kuroda et al. | |
| 5,500,281 | A | 3/1996 | Srinivasan et al. | |
| 5,509,913 | A | 4/1996 | Yeo | |
| 5,916,678 | A | 6/1999 | Jackson et al. | |
| 5,935,880 | A | 8/1999 | Wang et al. | |
| 5,948,710 | A | 9/1999 | Pomplun et al. | |
| 6,127,593 | A * | 10/2000 | Bjorkquist et al. | 604/364 |
| 6,423,804 | B1 | 7/2002 | Chang et al. | |
| 6,433,245 | B1 * | 8/2002 | Bjorkquist et al. | 604/364 |
| 6,548,592 | B1 | 4/2003 | Lang et al. | |
| 6,586,529 | B2 | 7/2003 | Mumick et al. | |
| 6,960,371 | B2 | 11/2005 | Bunyard et al. | |
| 6,994,865 | B2 | 2/2006 | Branham et al. | |
| 7,101,612 | B2 | 9/2006 | Lang et al. | |
| 7,189,307 | B2 | 3/2007 | Goulet et al. | |
| 7,229,529 | B2 | 6/2007 | Goulet et al. | |
| 7,276,459 | B1 | 10/2007 | Lang et al. | |
| 7,303,650 | B2 | 12/2007 | Hermans et al. | |
| 7,449,085 | B2 | 11/2008 | Hermans et al. | |
| 7,678,228 | B2 | 3/2010 | Goulet et al. | |
| 7,678,232 | B2 | 3/2010 | Shannon et al. | |
| 7,678,856 | B2 | 3/2010 | Goulet et al. | |
| 7,732,057 | B2 | 6/2010 | Stokes et al. | |
| 7,767,059 | B2 | 8/2010 | Ryan et al. | |
| 7,776,772 | B2 | 8/2010 | Barnholtz et al. | |
| 7,838,725 | B2 | 11/2010 | Noda et al. | |
| 7,989,545 | B2 | 8/2011 | Farwaha et al. | |
| 8,088,252 | B2 | 1/2012 | Farwaha et al. | |
| 8,133,952 | B2 | 3/2012 | Pisanova et al. | |
| 8,282,777 | B2 | 10/2012 | Bouplon et al. | |
| 2003/0102096 | A1 | 6/2003 | Dwiggins et al. | |
| 2006/0003649 | A1 * | 1/2006 | Runge et al. | 442/59 |
| 2006/0003654 | A1 * | 1/2006 | Lostocco et al. | 442/149 |
| 2007/0044891 | A1 | 3/2007 | Sellars | |
| 2012/0144611 | A1 * | 6/2012 | Baker et al. | 15/104.93 |
| 2013/0029106 | A1 * | 1/2013 | Lee et al. | 428/172 |

OTHER PUBLICATIONS

International Search Report and Written Opinion of the International Searching Authority received for International Patent Application No. PCT/US201/034510, mailed Aug. 27, 2014 (9 pages).

* cited by examiner

*Primary Examiner* — Mark Halpern
(74) *Attorney, Agent, or Firm* — Michael Best & Friedrich LLP

(57) ABSTRACT

A dispersible article and methods of making the same. The article has a web of fibers and a dried binder in contact with the fibers. The web of fibers has a basis weight of from about 10 gsm to about 150 gsm. The dried binder has a polyfunctional aldehyde and a primary polymer. The primary polymer has at least one functional group that is reactive with the fibers or the polyfunctional aldehyde. The fibers have at least one functional group that is reactive with the polyfunctional aldehyde or the primary polymer. The article has a cross direction wet tensile strength after 15 minutes of aqueous saturation that is at least about 30% of an initial cross direction wet tensile strength. The article is flushable.

21 Claims, 1 Drawing Sheet

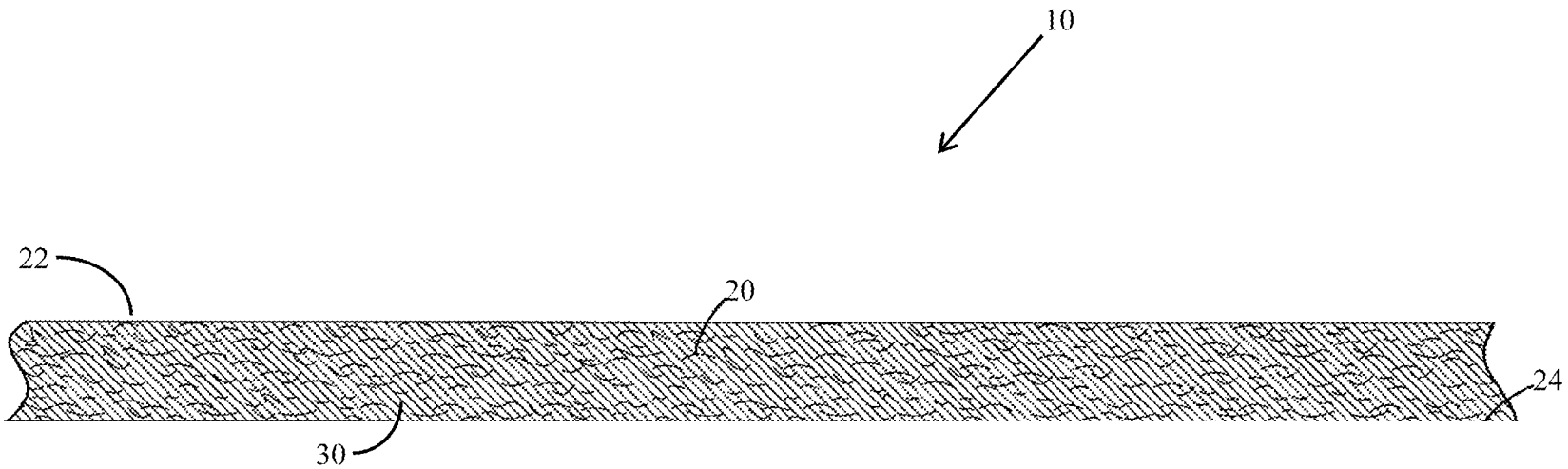
10
22
20
30
24

DISPERSIBLE ARTICLES AND METHODS OF MAKING THE SAME

CROSS REFERENCE TO RELATED APPLICATION

This application claims priority to U.S. Provisional Application No. 61/813,092, filed on Apr. 17, 2013, which is incorporated herein by reference in its entirety.

BACKGROUND

The present invention relates to dispersible articles.

The ability to easily dispose of single use paper or non-woven articles has been the objective of numerous programs. Such products call for good wet and dry strength of the product during use, but for the product to disintegrate in aqueous environments without clogging domestic waste disposal or septic systems. Products that would benefit from such properties include wipes, toweling used for wet or dry cleanup, napery, diaper and sanitary product covers, toilet papers and toilet seat covers.

Different technologies have provided dispersible paper and non-woven products. U.S. Pat. No. 5,916,678 uses multicomponent water-dispersible fibers. U.S. Pat. No. 5,935,880 discloses using a double recrepe (DRC) process to print a water-dispersible binder containing a divalent ion inhibiting agent. U.S. Pat. No. 5,948,710 coforms a fibrous nonwoven composite using a water-degradable reinforcing fiber matrix (for example, water soluble poly(vinyl alcohol) copolymer and fluff wood pulp composite). U.S. Pat. No. 5,500,281 and U.S. Pat. No. 7,776,772 disclose the use of water soluble fibers such as polyvinyl alcohol as a blend with other fibers. U.S. Pat. No. 5,252,332 uses a soluble binder such as polyvinyl alcohol.

U.S. Pat. No. 7,838,725 describes a mechanically weakened paper. The web contains two "mechanically weakened" layers that are joined by a water sensitive binder such as polyvinyl alcohol or starch. Salt sensitive polymeric ("ion trigger") binders are insoluble in aqueous salt solutions but soluble when the salt solution is diluted, allowing the production of dispersible paper and non-woven products. An issue is that salt solutions can be irritating to sensitive skin. Preferably, these binders are relatively insensitive to calcium or magnesium ions. These salt sensitive binders are extensively disclosed; U.S. Pat. No. 5,312,883, U.S. Pat. No. 5,317,063, U.S. Pat. No. 5,384,189, U.S. Pat. No. 5,509,913, U.S. Pat. No. 6,423,804, U.S. Pat. No. 6,548,592, U.S. Pat. No. 6,586,529, U.S. Pat. No. 6,960,371, U.S. Pat. No. 6,994,865, U.S. Pat. No. 7,101,612, U.S. Pat. No. 7,276,459, U.S. Pat. No. 7,767,059, U.S. Pat. No. 7,989,545, U.S. Pat. No. 8,088,252.

U.S. Pat. No. 3,658,745 teaches crosslinking of polyvinyl alcohol with formaldehyde and glyoxal to provide a hydrogel. U.S. Pat. No. 8,133,952 teaches that a blocked glyoxal and polyvinyl alcohol can provide a curable aqueous composition. U.S. Pat. No. 4,279,959 teaches latex containing acrylamide functionality that is then modified with glyoxal that is useful for nonwovens. U.S. Pat. No. 7,732,057 provides a laminated veneer product containing a paper backing with a curable formaldehyde-free latex polymer.

U.S. Pat. No. 7,189,307 teaches a fibrous sheet comprising a topically-applied network of a cured binder composition resulting essentially from the cross-linking reaction of a carboxylated vinyl acetate-ethylene terpolymer emulsion and an epoxy-functional polymer. Example 11 in this patent discloses a binder which also incorporated glyoxal as a crosslinking agent in the latex formulation, using Kymene® 2064 (an epoxy-functional polymer) and Airflex 426 (a carboxylated vinyl acetate-ethylene terpolymer emulsion). Epoxy-functional polymers provide permanent wet strength and do not provide a dispersible non-woven or paper product. U.S. Pat. No. 7,229,529 describes a binder composition comprising 5-20 weight percent of glyoxal, glutaraldehyde or glyoxalated polyacrylamides as anti-blocking additives.

U.S. Pat. No. 7,678,228 describes a binder comprising a mixture of an azetidinium-reactive polymer, an azetidinium-functional cross-linking polymer and glyoxal, glutaraldehyde, waxes or sugars as anti-blocking additives. Azetidinium-functional cross-linking polymers provide permanent wet strength and do not provide a dispersible non-woven or paper product. U.S. Pat. No. 7,678,856 also discloses polymers that provide permanent wet strength and does not provide a dispersible non-woven or paper product. U.S. Pat. No. 7,767,059 describes bathroom tissue or facial tissue having strength regions and dispersability regions. U.S. Pat. No. 7,449,085 discloses absorbent paper products which have a combination of high absorbent capacity and a moderate to low rate of absorbency for hand protection. U.S. Pat. No. 7,303,650 discloses treating one side of the paper web with a bonding material according to a preselected pattern and creped from a creping surface. Through the process, a two-sided tissue web is formed having a smooth side and a textured side.

The aforementioned U.S. Patents which are hereby incorporated by reference. However, in the event of any conflict between such patents and this document, the contents of this document take precedence.

SUMMARY

While flushable non-woven wet wipes are currently available that use a binder that can function when wet, there exists a need to have a dry wipe that is flushable. The non-woven wipes with a dry binder that are currently available provide wet tensile strength that is either too low initially to function effectively after aqueous saturation or too high to afford flushability. Thus, there exists a need for a flushable dry wipe having good dry and wet strength for at least 15 minutes upon aqueous saturation.

In particular, it is desirable to have a dry wipe or towel that can be used for cleaning using a cleaning agent or water, wherein the disintegration of the binder is controlled and would allow for enough time for the product to be useful. It would be beneficial for the item to have sufficient wet strength to be used for a period of time of 15 to 30 minutes and then be flushable in a toilet and of degradable material that would be safe for home sanitary and septic systems.

In one embodiment, the invention provides a dispersible article including a web of fibers and a dried binder in contact with the fibers. The web of fibers has a basis weight of from about 10 gsm to about 150 gsm. The dried binder includes a polyfunctional aldehyde and a primary polymer. The primary polymer has at least one functional group that is reactive with the fibers or the polyfunctional aldehyde. The fibers have at least one functional group that is reactive with the polyfunctional aldehyde or the primary polymer. The at least one functional group of the primary polymer may be chemically reactive with the fibers or the polyfunctional aldehyde. The at least one functional group of the fibers may be chemically reactive with the polyfunctional aldehyde or the primary polymer. The article has a cross direction wet tensile strength after 15 minutes of aqueous saturation that is at least about 30% of an initial cross direction wet tensile strength. The cross direction wet tensile strength may be determined in accordance with the Association of the Nonwoven Fabrics Industry (INDA) WSP 110.4.R4 Strip Tensile Test, 2012 revision. The article is flushable.

The primary polymer may comprise at least one polymeric segment selected from the group consisting of vinyl acetate, ethylene, vinyl alcohol, and combinations thereof. The polyfunctional aldehyde may be a polyfunctional aldehyde-containing polymer, a low molecular weight polyfunctional aldehyde, a protected polyfunctional aldehyde, a glyoxalated polyacrylamide, glyoxal, a methanol protected polyfunctional aldehyde, or any combination thereof. The polyfunctional aldehyde may be glyoxal. The dried binder may further comprise a secondary polymer comprising hydroxyl functionality. The ratio by dry weight of primary polymer to polyfunctional aldehyde in the dried binder may be from about 95:5 to about 50:50. The article may comprise dried binder in an amount from about 1 wt % to about 50 wt % of the total weight of the article. The web of fibers may comprise natural fibers, synthetic fibers, or a combination thereof. The natural fibers may be cellulosic fibers, for example. The natural cellulosic fibers may be pulped cellulosic fibers. The web of fibers may comprise recycled fibers. The article may have a pass through percentage value of at least about 50% through a 12.5 mm sieve. The initial cross direction wet tensile strength may be at least about 20% of an initial cross direction dry tensile strength.

The dried binder that is in contact with the fibers may be formed by contacting the web with a binder composition using a spray process, a saturation process, a printing process, or a combination thereof or wherein the binder composition is applied and dried on the web. For example, the binder composition may be dried on the web with a drying can, via air dryers, or other methods used for nonwoven or specialty paper processes. The binder composition may be dried to form a bonded web. The binder composition may be dried on the web in a double re-crepe process to form the dried binder. The binder composition may comprise formaldehyde in an amount of less than about 0.1 wt % or inorganic salt in an amount of less than about 0.1 wt %.

In another embodiment, the invention provides a method of making a dispersible article, the method including forming a web of fibers, contacting the web of fibers with a binder composition, and drying the binder composition to form a dried binder in contact with the web of fibers. The web of fibers has a basis weight of from about 10 gsm to about 150 gsm. The binder composition includes an aqueous polymer dispersion and a polyfunctional aldehyde. The article has a cross direction wet tensile strength after 15 minutes of aqueous saturation that is at least about 30% of an initial cross direction wet tensile strength. The cross direction wet tensile strength may be determined in accordance with the Association of the Nonwoven Fabrics Industry (INDA) WSP 110.4.R4 Strip Tensile Test, 2012 revision. The article is flushable. The article may have a pass through percentage value of at least about 50% through a 12.5 mm sieve.

The aqueous polymer dispersion may comprise a primary polymer comprising at least one polymeric segment selected from the group consisting of vinyl acetate, ethylene, vinyl alcohol, and combinations thereof. The polyfunctional aldehyde may be selected from the group consisting of an aldehyde-containing polymer, a low molecular weight polyfunctional aldehyde, a protected polyfunctional aldehyde, a glyoxalated polyacrylamide, glyoxal, a methanol protected polyfunctional aldehyde, and combinations thereof. The primary polymer may have a glass transition temperature of less than about 60° C. The web of fibers may be formed via wet forming, air laying, dry forming or a combination thereof. The contacting step may be performed using a spray process, a saturation process, a printing process, or a combination thereof. The contacting and drying steps may be performed as part of a double re-crepe process.

Other aspects of the invention will become apparent by consideration of the detailed description and accompanying drawings.

BRIEF DESCRIPTION OF THE DRAWINGS

FIG. 1 is a cross-sectional view of an article comprising a web of fibers and a dried binder in contact with the fibers, where the ratio of web of fibers to dried binder is not drawn to scale.

DETAILED DESCRIPTION

Before any embodiments of the invention are explained in detail, it is to be understood that the invention is not limited in its application to the details of construction and the arrangement of components set forth in the following description. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

It also is understood that any numerical range recited herein includes all values from the lower value to the upper value. For example, if a concentration range is stated as 1% to 50%, it is intended that values such as 2% to 40%, 10% to 30%, or 1% to 3%, etc., are expressly enumerated in this specification. These are only examples of what is specifically intended, and all possible combinations of numerical values between and including the lowest value and the highest value enumerated are to be considered to be expressly stated in this application.

As used herein in reference to the individual components of the article, such as the fibers or components of the binder, degradable shall indicate passing the American Society for Testing and Materials (ASTM) D6400-12 Standard Specification for Labeling of Plastics Designed to be Aerobically Composted in Municipal of Industrial Facilities.

As used herein, the terms dispersible and dispersable can be used interchangeably, and the terms dispersibility and dispersability can be used interchangeably.

This disclosure provides dispersible articles and methods of making the same.

Dispersible Articles

Referring to FIG. 1, the dispersible articles 10 disclosed herein include a web of fibers 20 and a dried binder 30 in contact with the fibers 20. The article or web of fibers includes a first side 22 and a second side 24.

Web of Fibers

The web of fibers includes material capable of serving as a base for the dispersible article having the properties described herein, particularly the strength and flushability properties. In principle, this involves competing forces, as the web of fibers must be bound together strongly enough to provide sufficient wet strength to function as a wipe for some period of time after contacting water, but not bound together too strongly to impede flushability.

The web of fibers includes degradable fibers and optionally includes nondegradable fibers. Degradable fibers include, but are not limited to, natural degradable fibers, such as scoured cotton and wool; pulped degradable fibers, such as pulped cellulosic fibers, including pulped wood fibers, pulped cotton fibers, pulped abaca fibers, pulped hemp fibers, pulped flax fibers and pulped jute fibers; and synthetic degradable fibers, such as synthetic cellulosic fibers, including rayon and lyocell. Nondegradable fibers include, but are not limited to, polyesters, such as polyethylene terephthalate, polybutylene terephthalate and polylactic acid; polyolefins, such as polypropylenes, polyethylenes and copolymers thereof; and polyamids, such as nylons.

In some embodiments, the web of fibers includes at least about 80% degradable fibers, at least about 85%, at least about 90%, at least about 95%, at least about 96%, at least about 97%, at least about 98%, at least about 99%, at least about 99.5% or at least about 99.9% degradable fibers. In some embodiments, the web of fibers includes at most about 100% degradable fibers, at most about 99.9% degradable fibers, at most about 99.5% degradable fibers, at most about 99% degradable fibers, at most about 98% degradable fibers, at most about 97% degradable fibers, at most about 97% degradable fibers, or at most about 95% degradable fibers. This includes embodiments where the web of fibers includes degradable fibers in amounts ranging from about 80% to about 100%, including but not limited to, amounts ranging from about 90% to about 99.9%, and amounts ranging from about 95% to about 99%.

In some embodiments, the web of fibers includes at least about 5% cellulosic fibers, at least about 10%, at least about 15%, at least about 20%, at least about 25%, at least about 30%, at least about 35%, at least about 40%, at least about 45%, at least about 50%, at least about 55%, at least about 60%, at least about 65%, at least about 70%, at least about 75%, at least about 80%, at least about 85%, at least about 90%, or at least about 95% cellulosic fibers. In some embodiments, the web of fibers includes at most about 100% cellulosic fibers, at most about 95%, at most about 90%, at most about 85%, at most about 80%, at most about 75%, at most about 70%, at most about 65%, at most about 60%, at most about 55%, at most about 50%, at most about 45%, at most about 40%, at most about 35%, at most about 30%, at most about 25%, at most about 20%, at most about 15%, or at most about 10% cellulosic fibers. This includes embodiments where the web of fibers includes cellulosic fibers in amounts ranging from about 5% to about 100%, including but not limited to, amounts ranging from about 50% to about 99.9%, and amounts ranging from about 90% to about 99%. In certain embodiments, the web of fibers includes about 100% cellulosic fibers. In preferred embodiments, the web of fibers includes at least about 50% cellulosic fibers.

In some embodiments, the web of fibers includes at least about 5% natural fibers, at least about 10%, at least about 15%, at least about 20%, at least about 25%, at least about 30%, at least about 35%, at least about 40%, at least about 45%, at least about 50%, at least about 55%, at least about 60%, at least about 65%, at least about 70%, at least about 75%, at least about 80%, at least about 85%, at least about 90%, or at least about 95% natural fibers. In some embodiments, the web of fibers includes at most about 100% natural fibers, at most about 95%, at most about 90%, at most about 85%, at most about 80%, at most about 75%, at most about 70%, at most about 65%, at most about 60%, at most about 55%, at most about 50%, at most about 45%, at most about 40%, at most about 35%, at most about 30%, at most about 25%, at most about 20%, at most about 15%, or at most about 10% natural fibers. This includes embodiments where the web of fibers includes natural fibers in amounts ranging from about 5% to about 100%, including but not limited to, amounts ranging from about 50% to about 99.9%, and amounts ranging from about 90% to about 99%. In certain embodiments, the web of fibers includes about 100% natural fibers.

In some embodiments, the web of fibers includes at most about 20% nondegradable fibers, at most about 15%, at most about 10%, at most about 5%, at most about 4%, at most about 3%, at most about 2%, at most about 1%, at most about 0.5%, or at most about 0.1% nondegradable fibers. In certain embodiments, the web of fibers includes about 0% nondegradable fibers.

In some embodiments, the web of fibers includes recycled fibers. In some embodiments, the web of fibers includes at least about 1% recycled fibers, at least about 5%, at least about 10%, at least about 15%, at least about 20%, at least about 25%, at least about 30%, at least about 35%, at least about 40%, at least about 45%, at least about 50%, at least about 55%, at least about 60%, at least about 65%, at least about 70%, at least about 75%, at least about 80%, at least about 85%, at least about 90%, or at least about 95% recycled fibers. In some embodiments, the web of fibers includes at most about 100% recycled fibers, at most about 95%, at most about 90%, at most about 85%, at most about 80%, at most about 75%, at most about 70%, at most about 65%, at most about 60%, at most about 55%, at most about 50%, at most about 45%, at most about 40%, at most about 35%, at most about 30%, at most about 25%, at most about 20%, at most about 15%, or at most about 10% recycled fibers. This includes embodiments where the web of fibers includes recycled fibers in amounts ranging from about 1% to about 100%, including but not limited to, amounts ranging from about 10% to about 80%, and amounts ranging from about 30% to about 50%. In some embodiments, the web of fibers includes about 100% recycled fibers.

The web of fibers may be formed by wet or dry techniques. Examples of wet processes include, but are not limited to, traditional or specialty papermaking processes capable of handling pulp or "short cut" synthetic fibers, use of traditional Fourdrinier machines, processes using cylinder or incline wire machines that can handle longer fiber furnishes, and the like. Examples of dry processes include, but are not limited to, forming an air laid web.

Fibers

In some embodiments, the fibers include at least one functional group that is reactive with the polyfunctional aldehyde or the primary polymer. In certain embodiments, the fibers include at least one functional group that is reactive with the polyfunctional aldehyde.

In some embodiments, the fibers include cellulosic fibers. Suitable cellulosic fibers include, but are not limited to, wood pulp cellulosic fibers, synthetic cellulosic fibers, cotton fibers, linen fibers, jute fibers, hemp fibers, hardwood fiber furnishes, softwood fiber furnishes, and the like.

In some embodiments, the fibers may be pulped by chemical or mechanical means. In some embodiments, the fibers may be bleached or unbleached. In some embodiments, the fibers may be post treated. In some embodiments, the post treatment may include being mercerized, crosslinked or further chemically treated.

In some embodiments, the fibers may have an average length of at most about 40 mm, at most about 35 mm, at most about 30 mm, at most about 25 mm, at most about 20 mm, at most about 15 mm, at most about 10 mm, or at most about 5 mm. In some embodiments, the fibers may have an average length of at least about 0.01 mm, at least about 0.05 mm, at least about 0.1 mm, at least about 0.5 mm, at least about 1 mm, or at least about 5 mm.

Dried Binder

The dried binder includes material capable of serving as a binding agent for the dispersible article having the properties described herein, particularly the strength and flushability properties. In principle, this involves competing forces, as the binder must bind strongly enough to provide sufficient wet strength to function as a wipe for some period of time after contacting water, but does not bind too strongly to impede flushability. In certain embodiments, the dried binder includes a polyfunctional aldehyde and a primary polymer.

In some embodiments, the article includes a ratio by dry weight of primary polymer to polyfunctional aldehyde in the dried binder of at least about 1:99, at least about 5:95, at least about 10:90, at least about 20:80, at least about 30:70, at least about 40:60, at least about 50:50, at least about 55:45, at least about 60:40, at least about 65:35, at least about 70:30, at least about 75:25, at least about 80:20, at least about 85:15, or at least about 90:10. In some embodiments, the article includes a ratio by dry weight of primary polymer to polyfunctional aldehyde in the dried binder of at most about 99:1, at most about 95:5, at most about 90:10, at most about 85:15, at most about 80:20, at most about 75:25, at most about 70:30, at most about 65:35, at most about 60:40, or at most about 55:45, at most about 50:50, at most about 40:60, at most about 30:70, at most about 20:80, at most about 10:90, or at most about 5:95. This includes embodiments having ratios by dry weight of primary polymer to polyfunctional aldehyde ranging from about 1:99 to about 99:1, such as ratios ranging from about 50:50 to about 95:5, ratios ranging from about 60:40 to about 92.5:7.5, and ratios ranging from about 70:30 to about 90:10.

In order to achieve a flushable article, the dried binder may not include permanent wet strength agents. The dried binder may not include permanent wet strength agents that would provide permanent wet strength to an article. Examples of permanent wet strength agents include, but are not limited to, the Kymene® series (Ashland Inc., Covington, Ky.), which includes azetidinium-containing resins, such as Kymene® 557H, Kymene® 821, Kymene® 830, Kymene® G3 X-Cel, Kymene® GHP 20, and Kymene® 736, epoxide-containing resins, such as Kymene® 450, and the like. The dried binder may not include permanent wet strength agents that would provide permanent wet strength to an article with the proviso that the article has a CDWT, as measured by the INDA WSP 110.4.R4 Strip Tensile Test, 2012 revision, that is at most about 60% of the initial CDWT after at least 360 minutes of aqueous saturation, at least 240 minutes, at least 120 minutes, at least 60 minutes of aqueous saturation. In some embodiments, the dried binder may not include permanent wet strength agents that would provide permanent wet strength to an article with the proviso that the article has a CDWT, as measured by the INDA WSP 110.4.R4 Strip Tensile Test, 2012 revision, that is at most about 50%, at most about 40%, at most about 30%, at most about 20%, or at most about 10% of the initial CDWT after 120 minutes of aqueous saturation.

Binder Composition

In some embodiments, the dried binder is formed by contacting the web with a binder composition. In some embodiments, the dried binder is formed by drying the binder composition. The binder composition includes all components of the dried binder, as well as any solvents or excipients necessary to accommodate contacting the web with the binder composition and forming the dried binder. Generally, any component of the binder composition that is not a part of the dried binder may be removable by the contacting and drying process.

The binder composition may have a pH of from 3 to 8. For example, the pH of the binder composition may be from 4 to 7 or from 5 to 6. Without wishing to be bound by any particular theory, a lower pH may provide greater wet strength with a polyfunctional aldehyde. However, too low of a pH may negatively impact the flushability of the article.

Stability of the binder composition can be achieved by the use of other small molecules that react with a polyfunctional aldehyde, generating a protected aldehyde and preventing reaction with polyhydroxyl containing polymers in the composition. These small molecules are chosen such that upon exposure to elevated temperatures the protected aldehyde reverts to its original constituent parts. Examples include reaction of urea and glyoxal to generate dihydroxyimidazolidinones. These materials can be reacted further with hydroxyl containing small molecules to generate substituted dihydroxyimidazolidinones. These materials have been used to prepare to stable binder formulations, however upon applying heat such materials have been found to not provide the necessary wet tensile performance. Without wishing to be bound by any particular theory, it is thought that these small molecules can react with the applied polyfunctional aldehyde which prevents the latter from reacting with polyhydroxyl containing polymers and substrate fiber to develop wet tensile performance. Volatile small molecules such as methanol can be effectively reacted with polyfunctional aldehydes to generate adducts that can be used to produce stable binder compositions. Because the small molecule evaporates during application, it does not interfere with wet tensile development. However this approach is limited where volatile organic emissions are of concern.

Preferably, the binder composition is a stable formulation. A stable formulation would preferably not gel under typical storage conditions and would preferably not separate into phases. Without wishing to be bound by any particular theory, it is believed that a stable formulation is difficult to achieve because the polyfunctional aldehyde may interact with a polyhydroxyl containing polymer to form hemi-acetal linkages in an aqueous composition, thereby negatively impacting the stability. Stability can be improved by adding a secondary polymer, such as polyvinyl alcohol, or a low molecular weight polyhydroxyl component, such as sugar or a hydrolyzed starch, such as glucose. To maximize the initial wet strength, polyhydroxyl components should be added in the minimum amount to provide the desired stability. Without wishing to be bound by any particular theory, low molecular weight polyhydroxyl components interact with the polyfunctional aldehyde to minimize its crosslinking with a polyvinyl alcohol stabilized polymer to improve stability, but the interaction will typically decrease the initial wet strength of the article.

Polyfunctional Aldehyde

Polyfunctional aldehydes may serve as a crosslinker between a functional group on the fibers, such as a hydroxyl group, and other components of the dried binder. The polyfunctional aldehyde includes polyfunctional aldehydes capable of interacting with the various other components of the dispersible article in order to provide the properties described herein, particularly the strength and flushability properties.

In some embodiments, the polyfunctional aldehyde may be selected from the group consisting of an aldehyde-containing polymer, a low molecular weight polyfunctional aldehyde, protected polyfunctional aldehyde, and combinations thereof. In certain embodiments, the polyfunctional aldehyde may be selected from the group consisting of glyoxalated polyacrylamide, glyoxal, methanol protected polyfunctional aldehydes and combinations thereof. The polyfunctional aldehyde may be glyoxal.

Primary Polymer

The primary polymer includes polymers capable of interacting with the other components of the dispersible article in order to provide the properties described herein, particularly the strength and flushability properties.

In some embodiments, the primary polymer includes at least one functional group that is reactive with the fibers or polyfunctional aldehyde. In certain embodiments, the primary polymer includes at least one functional group that is reactive with the polyfunctional aldehyde. In certain embodiments, the primary polymer may interact with the fibers via non-covalent interactions such as hydrogen bonds, Van der Waals forces, and the like.

The term polymeric segments, as used herein, refers to some portion of the overall polymer structure. For example, a vinyl acetate homopolymer has at least one polymeric segment that is vinyl acetate. A vinyl acetate ethylene copolymer has at least one polymeric segment that is vinyl acetate and at least one polymeric segment that is ethylene. In principle, a polymeric segment can be of any size smaller than the size of the polymer itself. In some embodiments, the primary polymer includes hydrophobic polymeric segments, hydrophilic polymeric segments, water-soluble polymeric segments, and combinations thereof. In some embodiments, the primary polymer includes at least one polymeric segment selected from the group consisting of vinyl acetate, ethylene, vinyl alcohol, styrene, butadiene, methyl methacrylate, methyl acrylate, ethyl methacrylate, ethyl acrylate, butyl methacrylate, butyl acrylate, isobutyl methacrylate, isobutyl acrylate, 2-ethylhexyl acrylate, lauryl methacrylate, lauryl acrylate, acrylic acid and its salts, methacrylic acid and its salts, itaconic acid and its salts, acrylamide, hydroxyethyl methacrylate, hydroxyethyl acrylate, partially and fully hydrolyzed polyvinyl alcohol, and polysaccharides (e.g., starch, hydroxyethylcellulose). In certain embodiments, the primary polymer include at least one polymeric segment selected from the group consisting of vinyl acetate, ethylene, and vinyl alcohol. Without wishing to be bound by any particular theory, it is believed that the hydroxyl, amino, amido, sulfide, mercapto and sulfite functionality on the primary polymer may be reactive with the polyfunctional aldehyde.

In certain embodiments, the primary polymer may be dispersible in water. In some embodiments, the primary polymer may be formed by emulsion polymerization. In certain embodiments, the primary polymer is a poly(vinyl alcohol) stabilized vinyl acetate-ethylene copolymer.

The performance of the primary polymer may be impacted by its glass transition temperature. Without wishing to be bound by any particular theory, it is believed that the glass transition temperature may have an impact on forming a stable binder composition that can be brought into contact with a web of fibers. However, there is no particular limitation with respect to the glass transition temperature and the dried binder in contact with the fibers. Nonetheless, without wishing to be bound by any particular theory, use of a primary polymer having a lower glass transition temperature may yield a softer article. In some embodiments, the primary polymer has a glass transition temperature of at most about 150° C., at most about 140° C., at most about 130° C., at most about 120° C., at most about 110° C., at most about 100° C., at most about 90° C., at most about 80° C., at most about 70° C., at most about 60° C., at most about 50° C., or at most about 40° C. In some embodiments, the primary polymer has a glass transition temperature of at least about −50° C., at least about −40° C., at least about −30° C., at least about −20° C., at least about −10° C., at least about 0° C., at least about 10° C., at least about 20° C., or at least about 30° C. This includes embodiments having primary polymers with glass transition temperatures ranging from about −50° C. to about 150° C., such as glass transition temperatures ranging from about −40° C. to about 60° C., and glass transition temperatures ranging from about −20° C. to about 20° C.

In embodiments where the primary polymer is a vinyl acetate ethylene copolymer, the vinyl acetate content may be at least about 60%, at least about 65%, at least about 70%, at least about 75%, at least about 80%, at least about 85%, or at least about 90% by weight of the polymer. In embodiments where the primary polymer is a vinyl acetate ethylene copolymer, the vinyl acetate content may be at most about 95%, at most about 90%, at most about 85%, at most about 80%, at most about 75%, at most about 70%, or at most about 65% by weight of the polymer.

In some embodiments, the primary polymer is stabilized by a suitable stabilizer. In some embodiments, the primary polymer is stabilized by a surfactant, a stabilizing polymer, or a combination thereof. In certain embodiments, the stabilizing polymer is a polyhydroxyl containing polymer, such as polyvinyl alcohol, a carboxylate containing polymer, or combinations thereof.

In certain embodiments, the polyvinyl alcohol may be at least 50% hydrolyzed, at least 75% hydrolyzed, at least 80% hydrolyzed, at least 85% hydrolyzed, at least 90% hydrolyzed, at least 95% hydrolyzed, or at least 99% hydrolyzed. In certain embodiments, the secondary polymer may have molecular weights ranging from about 10 kDa to about 500 kDa, including but not limited to, molecular weights ranging from about 31 kDa to about 50 kDa, 13 kDa to about 23 kDa, or 10 kDa to about 50 kDa.

Examples of commercially available primary polymers include, but are not limited to, the VINNAPAS® series (Wacker Chemical Corporation, Allentown, Pa.), the ELEVATE™ series (Westlake Chemical, Houston, Tex.), and the Elvax® series (DuPont™, Wilmington, Del.).

Secondary Polymer

In one embodiment, the dried binder or binder composition includes a secondary polymer. The secondary polymer can be added to improve the flushability of an article, by altering the properties of the dried binder. The secondary polymer can also improve the properties of the binder composition as it relates to application to the web of fibers and drying to form the dried binder, for example improving the dryer process (e.g., a double re-crepe process). Suitable secondary polymers include polymers capable of interacting with the other components described herein to provide the properties described herein.

In some embodiments, the secondary polymer includes hydroxyl, amino, amido, sulfide, mercapto or sulfite functionality. In certain embodiments, the secondary polymer includes hydroxyl functionality. In certain embodiments, the secondary polymer is polyvinyl alcohol, preferably a low-molecular weight polyvinyl alcohol. Without wishing to be bound by any particular theory, it is believed that the secondary polymer competes with the primary polymer to react with the polyfunctional aldehyde, thereby reducing the degree of crosslinking in the dried binder. Without wishing to be bound by any particular theory, it is believed that hydroxyl, amino, amido, sulfide, mercapto and sulfite functionality on the secondary polymer may be reactive with the polyfunctional aldehyde.

Examples of commercially available secondary polymers include, but are not limited to, the Selvol™ series (Sekisui Specialty Chemicals America, LLC, Dallas, Tex.), the Elvanol® series (Dupont™, Wilmington Del.), and the Mowiol® and Poval® series (Kuraray Europe GmbH, Hattersheim, Germany).

In some embodiments, the article includes a ratio by dry weight of primary polymer to dry weight of secondary polymer in the dried binder of at least about 50:50, at least about 60:40, at least about 70:30, at least about 80:20, at least about 90:10, at least about 95:5 or at least about 100:0. In some embodiments, the article includes a ratio by dry weight of primary polymer to dry weight of secondary polymer in the dried binder of at most about 100:0, at most about 95:5, at most about 90:10, at most about 80:20, at most about 70:30, at most about 60:40 or at most about 50:50. This includes embodiments having ratios by dry weight of primary polymer to dry weight of secondary polymer ranging from about 50:50 to about 100:0, such as ratios ranging from about 50:50 to about 95:5, ratios ranging from about 60:40 to about 92.5:7.5, and ratios ranging from about 70:30 to about 90:10.

Other Additives

The binder composition may include other additives. Examples of such additives are lubricants, including surfactants and oils. Preferred surfactants include, but are not limited to, polyethylene glycol dioleate, such as polyethylene glycol 400 dioleate, and polyethylene glycol monooleate, such as polyethylene glycol 400 monoleate. Examples of lubricating oil include vegetable oil, mineral oil, natural wax and synthetic oil. In preferred embodiments, the lubricant may be mineral oil. An example of a commercially available lubricant is the Sunpar® series (Holly Refining & Marketing—Tulsa LLC, Tulsa, Okla.). Other suitable additives include trihydroxymethypropyl trioleate, carnauba wax, the Hyprene series (Ergon Refining Inc., Jackson, Miss.), the SpectraSyn™ series of polyalphaolefins (ExxonMobil Chemical Company, Beaumont, Tex.), and the like.

Flushability

In preferred embodiments, articles described herein are flushable. Flushability of an article may be determined by tests known to those of skill in the art. Preferably, flushability of an article may be determined by a series of tests, such as those set forth in the Association of the Nonwoven Fabrics Industry (INDA) and European Disposables and Nonwovens Association (EDANA) Guidance Document for Assessing the Flushability of Nonwoven Consumer Products, Second Edition, 2009 (INDA Guidance 2009), which is incorporated herein in its entirety by reference, wherein the ability for an article to be disposed via modern plumbing and sewage systems is evaluated.

In some embodiments, flushable indicates passing one, two, three, four or five of the following flushability tests: a) the article clearing a toilet bowl and trap on at least 90% of flushes and the article traveling greater than 10 m in a drainline over two flushes or traveling sufficient distance such that a distance traveled by a center of mass of the article does not show a downward trend over five flushes as measured by the INDA FG 510.1 Toilet Bowl and Drainline Clearance Test as recited in INDA Guidance 2009; b) the article settles all of the way to the bottom of a 115 cm column of water in less than 24 hours as measured by the INDA FG 512.1 Column Settling Test as recited in INDA Guidance 2009; c) more than 95% of the article passes through a 12 mm sieve after 3 hours of agitation in water as measured by the INDA FG 511.1 Dispersability Shake Flask Test as recited in INDA Guidance 2009 or after 240 cycles of rotating a cylinder containing water and the article as measured by the INDA FG 511.2 Dispersability Tipping Tube Test as recited in INDA Guidance 2009; d) more than 95% of the article passes through a 1 mm sieve after 28 days of exposure to an activated sludge as measured by the INDA FG 513.1 or 513.2 Aerobic Biodegradation Test as recited in INDA Guidance 2009 or more than 60% of the article is converted to carbon dioxide after 28 days of exposure to an activated sludge as measured by INDA FG 513.2 Aerobic Biodegradation Test as recited in INDA Guidance 2009; and e) more than 95% of the article passes through a 1 mm sieve after 28 days of exposure to an anaerobic digester sludge as measured by the INDA FG 514.1 Anaerobic Biodegradation Test as recited in INDA Guidance 2009 or more than 70% of carbon contained within the article is converted to gas or greater than 95% of the article passes through a 1 mm sieve after 56 days of exposure to an anaerobic digester sludge as measured by the INDA FG 514.2 Anaerobic Biodegradation Test as recited in INDA Guidance 2009.

In some embodiments, the article may have a pass through percentage value of at least about 20%, at least about 30%, at least about 40%, at least about 50%, at least about 60%, at least about 70%, at least about 75%, at least about 80%, at least about 85%, at least about 90%, at least about 95%, or at least about 99% through a 12.5 mm sieve as measured by the INDA FG 522.2 Slosh Box Test as recited in INDA Guidance 2009. In some embodiments, the article has a pass through percentage value of at least about 20%, at least about 30%, at least about 40%, at least about 50%, at least about 60%, at least about 70%, at least about 75%, at least about 80%, at least about 85%, at least about 90%, or at least about 95% through a 1.5 mm sieve as measured by the INDA FG 522.2 Slosh Box Test as recited in INDA Guidance 2009.

Strength

Articles described herein have a strength that is sufficient for the article to be used as a wipe for some period of time after contacting a liquid. Strength of an article may be determined by tests known to those of skill in the art. Preferably, strength of an article may be determined by a test, such as the INDA WSP 110.4.R4 Strip Tensile Test, 2012 revision, which is incorporated herein in its entirety by reference.

The decay of wet strength, preferably in a cross-machine direction, plotted versus time may be a measure of the functionality of the article. Various applications may require that articles remain usable for at least 1, 5, 10, 15, 30, 45, 60 or 90 minutes in a wet environment. Wet strength can be measured by any suitable method known to one of skill in the art. Suitable methods are described in INDA WSP 110.4.R4 Strip Tensile Test, 2012 revision or ASTM test method D5035-95, each of which is incorporated herein in its entirety by reference. The wet strength in the cross machine direction, or cross direction wet tensile strength (CDWT), may be measured by the tensile testing of 1 inch×6 inch samples that have been placed in water for a few seconds to 15 or 30 minutes. The decay of CDWT may be measured as a percentage of the initial CDWT, wherein the initial CDWT is measured within a few seconds of aqueous saturation.

In some embodiments, the article has a CDWT after at least 1 minute of aqueous saturation, at least 5 minutes, at least 10 minutes, at least 15 minutes, at least 20 minutes, at least 25 minutes, at least 30 minutes, at least 45 minutes, at least 60 minutes, or at least 90 minutes of aqueous saturation that is at least about 30% of the initial CDWT as measured by the INDA WSP 110.4.R4 Strip Tensile Test, 2012 revision. In some embodiments, the article has a CDWT after 15 minutes to 30 minutes of aqueous saturation that is at least about 5%, at least about 10%, at least about 20%, at least about 30%, at least about 40%, or at least about 50% of the initial CDWT as measured by the INDA WSP 110.4.R4 Strip Tensile Test, 2012 revision. In certain embodiments, the article has a CDWT after 15 to 30 minutes of aqueous saturation that is at least about 30% of the initial CDWT as measured by the INDA WSP 110.4.R4 Strip Tensile Test, 2012 revision.

In some embodiments, the article has an initial CDWT that is at least about 5%, at least about 10%, at least about 20%, at least about 30%, at least about 40% or at least about 50% of an initial cross direction dry tensile strength as measured by the INDA WSP 110.4.R4 Strip Tensile Test, 2012 revision.

In some embodiments, the article has a CDWT, as measured by the INDA WSP 110.4.R4 Strip Tensile Test, 2012 revision, that is at most about 60% of the initial CDWT after at least 360 minutes of aqueous saturation, at least 240 minutes, at least 120 minutes, at least 60 minutes of aqueous saturation. In some embodiments, the article has a CDWT, as measured by the INDA WSP 110.4.R4 Strip Tensile Test, 2012 revision, that is at most about 50%, at most about 40%, at most about 30%, at most about 20%, or at most about 10% of the initial CDWT after 120 minutes of aqueous saturation.

Methods of Making an Article

A method of making a dispersible article includes: forming a web of fibers; contacting the web of fibers with a binder composition; and drying the binder composition to form a dried binder in contact with the fibers. One of skill in the art will appreciate that other techniques are suitable for the methods described herein.

U.S. Pat. No. 3,879,257, which is incorporated herein in its entirety by reference, and in particular Example III of said patent, discloses a method of forming a web of fibers that is suitable for use with the methods described herein. Other suitable means of forming the web of fibers include, but are not limited to, wet forming, such as incline wire forming, Fourdrinier forming and cylinder forming; air forming, such as short fiber air forming and synthetic and/or wood pulp air forming; and dry forming, such as carding and bonding.

U.S. Patent Application Pub. No. 2007/0044891 and U.S. Pat. No. 8,282,777, each of which is incorporated herein in its entirety by reference, disclose methods of single recreping and double recreping that are suitable for use with the present invention. The binder composition and dried binder of this invention do not require a curing step, but one can be used if so desired. Other suitable means of contacting the web of fibers with a binder composition and drying the binder composition to form a dried binder in contact with the fibers include, but are not limited to, printing and drying, spraying and drying, foam coating and drying, size press addition and drying, blade coating and drying.

EXAMPLES

Vinnapas® 400 ("V-400") is a polyvinyl alcohol stabilized vinyl acetate-ethylene copolymer dispersion.

Vinnapas® 426 ("V-426") is a polyvinyl alcohol stabilized vinyl acetate-ethylene-acrylic acid terpolymer dispersion.

Vinnapas® 465 is a polyvinyl alcohol stabilized vinyl acetate-ethylene copolymer dispersion.

Selvol™ 203 is a polyvinyl alcohol dispersion with about 88% hydrolysis.

Sunpar® 150 is a highly refined paraffinic type oil.

Kymene® 920A ("K920A") is an azetidinium-containing wet-strength resin.

DUR-O-SET®10A ("Duroset") is a surfactant stabilized vinyl acetate-ethylene copolymer with crosslinking functionality to provide permanent wet strength.

For each of the Examples, softwood webs of fibers having a basis weight of 50 gsm were produced without binder in a process similar to Example III of U.S. Pat. No. 3,879,257.

Comparative Examples 1-7

A softwood web of fibers, prepared as described above, was processed by double-sided printing the compositions described in Table 1 in an amount of approximately 5% by weight of the total article per side or 10% by weight of the total article overall. For Comparative Example 1, DUR-O-SET®10A emulsion (Celenese Ltd. Irving, Tex.) was used with 1% ammonium chloride as a catalyst (dry ammonium chloride on dry emulsion), the composition was printed onto the web, and the article was cured for 15 minutes in a 150° C. oven. For Comparative Examples 2-7, the compositions were adjusted to a pH of 7, the pH-adjusted compositions were printed onto the web, and the article was cured for 15 minutes in a 105° C. oven. The results of cross direction dry tensile strength and CDWT testing are shown in Table 1.

TABLE 1

| | | | | | Dry Tensile | | Wet Tensile - Cross Direction (CD) | | | | | |
|---|---|---|---|---|---|---|---|---|---|---|---|---|
| | | | | | | | 10 sec | 1 min | 5 min | 15 min | 30 min | 120 min |
| Comp. Ex. | Binder Component 1 | (%) (dry/dry) | Binder Component 2 | (%) (dry/dry) | MD Peak Load g-f Mean | CD Peak Load g-f Mean | soak Peak Load g-f Mean | soak Peak Load g-f Mean | soak Peak Load g-f Mean | soak Peak Load g-f Mean | soak Peak Load g-f Mean | soak Peak Load g-f Mean |
| 1 | Duroset | 100% | none | 0% | 875 | 653 | 272 | 268 | 245 | 240 | 249 | 249 |
| 2 | V-426 | 95% | K920A | 5% | 798 | 572 | 159 | 154 | 154 | 154 | 168 | 159 |
| 3 | V-426 | 90% | K920A | 10% | 943 | 694 | 254 | 245 | 249 | 231 | 231 | 231 |
| 4 | V-426 | 85% | K920A | 15% | 1007 | 735 | 281 | 331 | 277 | 272 | 318 | 295 |
| 5 | V-426 | 80% | K920A | 20% | 1139 | 839 | 354 | 345 | 318 | 327 | 336 | 322 |
| 6 | V-400 | 90% | K920A | 10% | 953 | 726 | 159 | 154 | 150 | 159 | 159 | 154 |
| 7 | V-400 | 85% | K920A | 15% | 934 | 708 | 163 | 168 | 177 | 150 | 159 | 154 |

Comparative Examples 1-7 show the effect of using a permanent wet strength additive. The CDWT does not reduce over time, so the article will not be degradable or flushable.

For each of the following Examples 1-3 and Comparative Example 8, the binder composition was applied to a first side 22 of the web of fibers using an engraved roll with a crosshatched pattern. The article was transferred to a Yankee dryer for drying and creping upon exit from the dryer. A second application of binder composition was applied on a second side 24 using a second engraved roll with a crosshatched pattern. The article was transferred to a second Yankee dryer for drying and creping upon exit from the dryer.

Example 1

A softwood web of fibers, prepared as described above, was processed in a double recrepe process using the following binder composition: 56% dry solids basis Vinnapas® 465 (available from Wacker Chemical Corp., Allentown, Pa.), 30% dry solids basis glyoxal (available from Sigma-Aldrich Corp., St. Louis, Mo.), and 14% dry solids basis Selvol™ 203 (available from Sekisui Specialty Chemicals America, LLC, Dallas, Tex.). The solids in the binder composition were adjusted so that the web of fibers picked up binder composition in an amount to yield about 5% of the total weight of the article on each side, or a total of about 10% of the total weight of the article. The product was allowed to age for 7 days prior to the CDWT and Slosh Box testing described below.

Example 2

A softwood web of fibers, prepared as described above, was processed in a double recrepe process using the following binder composition: 70% dry solids basis Vinnapas® 400 (available from Wacker Chemical Corp., Allentown, Pa.) and 30% dry solids basis glyoxal (available from Sigma-Aldrich Corp., St. Louis, Mo.). The binder composition had a pH of 3.77. The solids in the binder composition were adjusted so that the web of fibers picked up binder composition in an amount to yield about 5% of the total weight of the article on each side, or a total of about 10% of the total weight of the article. The product was allowed to age for 7 days prior to the CDWT and Slosh Box testing described below.

Example 3

A softwood web of fibers, prepared as described above, was processed in a double recrepe process using the following binder composition: 53% dry solids basis Vinnapas® 400 (available from Wacker Chemical Corp., Allentown, Pa.), 30% dry solids basis glyoxal (available from Sigma-Aldrich Corp., St. Louis, Mo.), 5% dry solids basis Selvol™ 203 (available from Sekisui Specialty Chemicals America, LLC, Dallas, Tex.), 1% dry solids basis Sunpar® 150 (available from Holly Refining & Marketing-Tulsa LLC, Tulsa, Okla.), and 1% dry solids basis polyethylene glycol 400 oleate. The binder composition had a pH of 3.55. The solids in the binder composition were adjusted so that the web of fibers picked up binder composition in an amount to yield about 5% of the total weight of the article on each side, or a total of about 10% of the total weight of the article. The product was allowed to age for 7 days prior to the CDWT and Slosh Box testing described below.

Comparative Example 8

A softwood web of fibers, prepared as described above, was processed in a double recrepe process using the following binder composition: 89% dry solids basis Vinnapas® 400 (available from Wacker Chemical Corp., Allentown, Pa.), 8.5% dry solids basis Selvol™ 203 (available from Sekisui Specialty Chemicals America, LLC, Dallas, Tex.), 1% dry solids basis Sunpar® 150 (available from Holly Refining & Marketing—Tulsa LLC, Tulsa, Okla.) and 1% dry solids basis polyethylene glycol 400 dioleate. The binder composition had a pH of 4.59. The solids in the binder composition were adjusted so that the web of fibers picked up binder composition in an amount to yield about 5% of the total weight of the article on each side, or a total of about 10% of the total weight of the article. The product was allowed to age for 7 days prior to the CDWT and Slosh Box testing described below.

Example 4

Cross Direction Wet Tensile Strength

Examples 1-3 and Comparative Example 8 were cut from the cross machine direction into 1" by 6" samples for testing the CDWT and the decrease of that strength over time. The samples were immersed in water, and the CDWT was measured within a few seconds to determine the initial CDWT. Other samples were immersed in water for 15 or 30 minutes and the CDWT was measured at each of those respective intervals. The results are shown in Table 2.

Example 5

Dispersability

Examples 1-3 and Comparative Example 8 were cut into 6" by 7" samples, having a mass of around 1.5 grams, immersed in water for three hours, and transferred to a slosh box for disintegration. After the samples disintegrated, the resulting fibrous mixture was passed through screens of 12.5 mm and 1.5 mm. The material trapped on each screen was washed for 2 minutes with water at a flow rate of 4 liters per minute. The trapped material was collected, dried and weighed. The difference between initial weight of the sample and the measured weight is divided by the initial weight of the sample to provide a percentage pass through value, which is shown in Table 2.

TABLE 2

| Example | CDWT (g/inch) | | | Slosh Box (% pass) | |
|---|---|---|---|---|---|
| (*Comparative) | Initial | 15 min | 30 min | 12.5 mm | 1.5 mm |
| 1 | 310 | 106 | 25 | 100 | 92 |
| 2 | 455 | 252 | 168 | 100 | 89 |
| 3 | 460 | 250 | 141 | 100 | 100 |
| 8* | 221 | Not Tested | Not Tested | 86 | 41 |

As can be seen, Examples 1-3 pass each had an initial CDWT higher than that of Comparative Example 8, and each of which retained at least 30% of the initial CDWT after 15 minutes of aqueous saturation. Furthermore, Examples 1-3 each had a pass through percentage of 100% through the 12.5 mm sieve and a pass through percentage of greater than 85% through the 1.5 mm sieve. Notably, Example 3 had a pass through percentage of 100% through the 1.5 mm sieve.

As should be apparent from the above, independent embodiments of the invention provide articles for use, for example, as flushable wipes, and methods of manufacturing the same. Various features, advantages, and embodiments of the invention are set forth in the following claims:

What is claimed is:

1. A dispersible article comprising:

a web of fibers having a basis weight of from about 10 gsm to about 150 gsm; and a dried binder in contact with the fibers, the dried binder comprising a polyfunctional aldehyde and a primary polymer, the primary polymer comprising at least one functional group that is reactive with the fibers or the polyfunctional aldehyde, and the fibers comprising at least one functional group that is reactive with the polyfunctional aldehyde or the primary polymer, wherein the article has a cross direction wet tensile strength after 15 minutes of aqueous saturation that is at least about 30% of an initial cross direction wet tensile strength, and wherein the article is flushable.

2. The article of claim 1, wherein the primary polymer comprises at least one polymeric segment selected from the group consisting of vinyl acetate, ethylene, vinyl alcohol, and combinations thereof.

3. The article of claim 1, wherein the polyfunctional aldehyde is selected from the group consisting of a polyfunctional aldehyde-containing polymer, a low molecular weight polyfunctional aldehyde, a protected polyfunctional aldehyde, a glyoxalated polyacrylamide, glyoxal, a methanol protected polyfunctional aldehyde, and combinations thereof.

4. The article of any of the preceding claims, wherein the polyfunctional aldehyde is glyoxal.

5. The article of claim 1, wherein the dried binder further comprising a secondary polymer comprising hydroxyl functionality.

6. The article of claim 1, wherein a ratio by dry weight of primary polymer to polyfunctional aldehyde in the dried binder is from about 95:5 to about 50:50.

7. The article of claim 1, the article comprising dried binder in an amount from about 1 wt % to about 50 wt % of the total weight of the article.

8. The article of claim 1, wherein the web of fibers comprises natural fibers, synthetic fibers, or a combination thereof.

9. The article of claim 8, wherein the web of fibers comprises recycled fibers.

10. The article of claim 1, wherein the article has a pass through percentage value of at least about 50% through a 12.5 mm sieve.

11. The article of claim 1, wherein the initial cross direction wet tensile strength is at least about 20% of an initial cross direction dry tensile strength.

12. The article of claim 1, wherein the dried binder in contact with the fibers is formed by contacting the web with a binder composition using a spray process, a saturation process, a printing process, or a combination thereof or wherein the binder composition is applied and dried to form a bonded web.

13. The article of claim 12, wherein the binder composition comprises formaldehyde in an amount of less than about 0.1 wt % or inorganic salt in an amount of less than about 0.1 wt %.

14. A method of making a dispersible article, the method comprising:

forming a web of fibers having a basis weight of from about 10 gsm to about 150 gsm;

contacting the web of fibers with a binder composition, wherein the binder composition comprises an aqueous polymer dispersion and a polyfunctional aldehyde; and drying the binder composition to form a dried binder in contact with the web of fibers, wherein the article has a cross direction wet tensile strength after 15 minutes of aqueous saturation that is at least about 30% of an initial cross direction wet tensile strength, and wherein the article is flushable.

15. The method of claim 14, wherein the aqueous polymer dispersion comprises a primary polymer comprising at least one polymeric segment selected from the group consisting of vinyl acetate, ethylene, vinyl alcohol, and combinations thereof.

16. The method of claim 15, wherein the primary polymer has a glass transition temperature of less than about 60° C.

17. The method of claim 14, wherein the polyfunctional aldehyde is selected from the group consisting of an aldehyde-containing polymer, a low molecular weight polyfunctional aldehyde, a protected polyfunctional aldehyde, a glyoxalated polyacrylamide, glyoxal, a methanol protected polyfunctional aldehyde, and combinations thereof.

18. The method of claim 14, wherein forming a web of fibers comprises wet forming, air laying, dry forming or a combination thereof.

19. The method of claim 14, wherein the article has a pass through percentage value of at least about 50% through a 12.5 mm sieve.

20. The method of claim 14, wherein the contacting step is performed using a spray process, a saturation process, a printing process, or a combination thereof.

21. The method of claim 14, wherein the contacting and drying steps are performed as part of a double re-crepe process.

* * * * *